US007963004B2

(12) United States Patent
Cho

(10) Patent No.: US 7,963,004 B2
(45) Date of Patent: Jun. 21, 2011

(54) APPARATUS FOR ATTACHING EXTRANEOUS ITEM TO MILITARY UNIFORM

(75) Inventor: Young Sol Cho, Gyeonggi-do (KR)

(73) Assignee: Young Sol Cho, Gyeonggi-do (KR)

( * ) Notice: Subject to any disclaimer, the term of this patent is extended or adjusted under 35 U.S.C. 154(b) by 901 days.

(21) Appl. No.: 11/829,210

(22) Filed: Jul. 27, 2007

(65) Prior Publication Data

US 2010/0024173 A1 Feb. 4, 2010

(30) Foreign Application Priority Data

Jul. 28, 2006 (KR) ..... 20-2006-0020477 U

(51) Int. Cl.
*A44B 18/00* (2006.01)

(52) U.S. Cl. ..... 24/3.1; 24/306

(58) Field of Classification Search ..... 24/306, 24/442, 3.1; 40/1.5, 1.6
See application file for complete search history.

(56) References Cited

U.S. PATENT DOCUMENTS

| | | | | |
|---|---|---|---|---|
| 4,961,275 | A * | 10/1990 | Klein | 40/1.5 |
| 5,359,734 | A * | 11/1994 | Rathburn | 2/195.1 |
| 5,655,268 | A * | 8/1997 | Keyaki et al. | 24/306 |
| 5,740,557 | A * | 4/1998 | Reid et al. | 2/209.13 |
| 5,813,153 | A * | 9/1998 | Maglio | 40/1.6 |
| 5,924,139 | A * | 7/1999 | Van Den Heuvel | 2/209.13 |
| 6,339,866 | B1 * | 1/2002 | French | 24/306 |
| 6,519,779 | B1 * | 2/2003 | Taguchi | 2/209.12 |
| 6,994,044 | B2 * | 2/2006 | Kwon | 112/475.18 |

* cited by examiner

*Primary Examiner* — Robert J Sandy
(74) *Attorney, Agent, or Firm* — Occhiuti Rohlicek & Tsao LLP

(57) ABSTRACT

An apparatus for attaching an extraneous item to a military uniform is disclosed. The apparatus for attaching an extraneous item to a military uniform, which can attach a name tag, a unit marking, insignia of rank, etc. to a predetermined position of the military uniform, includes: a female Velcro tape where an attaching means is formed; an attaching member which is formed with the same size as the female Velcro tape and has the same pattern or color as the military uniform formed on the surface and a male Velcro tape formed on the back side; and an extraneous item comprising a name tag, a unit marking, insignia of rank, etc. to be attached to the surface of the attaching member.

2 Claims, 1 Drawing Sheet

APPARATUS FOR ATTACHING EXTRANEOUS ITEM TO MILITARY UNIFORM

This nonprovisional application claims priority under 35 U.S.C. §119(a) on Utility Model Application No. 20-2006-0020477 filed in Republic of Korea on Jul. 28, 2007 the entire contents of which are hereby incorporated by reference.

BACKGROUND

1. Field

This document relates to an apparatus for attaching an extraneous item to a military uniform.

2. Related Art

Generally, the term "articles of clothing" refer to kinds of clothes altogether, and its kinds and shapes are countless.

Further, articles of clothing are manufactured, with many technologies accumulated, to offer the optimum condition when real consumers wear these by providing various functions in recent years, as well as the basic function for adorning oneself.

It is not too much to say that, among articles of clothing, especially, military uniforms are the most scientifically manufactured clothes by taking functional aspects, climatic properties, or user's activity into consideration. By the way, military uniforms have the following common features regardless of countries.

That is, a unit marking, insignia of rank, or name tag is attached to a military uniform. Conventionally, each marking, insignia of rank, or name tag (hereinafter, abbreviated as an extraneous item) is directly attached to a military uniform by sewing for use.

However, if the military uniform is washed repetitively for a long period of time, with various kinds of extraneous items attached to the military uniform by sewing, there is a problem that the extraneous items are wrinkled without being kept in the initial stiff state.

The aforementioned problem results from the structural contradiction that the structure of the extraneous items is made of simple fiber yarns.

To solve this problem, recently, the surface of a pocket to be attached to a position where an extraneous item is attached, e.g., to a chest region, is formed of a female hook and loop fastener Velcro® tape, and a male hook and loop fastener Velcro® tape is installed to various extraneous items, so that the military uniform can be washed after separating the male Velcro® tape when washing.

However, in the structure as above where a specific position of the military uniform to which an extraneous item is to be attached is formed of a female Velcro® tape and the extraneous item is attached to and detached from the female Velcro® tape, another problem occurs as follows.

In other words, if it is assumed that the surface of a pocket attached to a chest region of a military uniform is 10 cm wide and 13 cm long, that region is entirely formed of a female Velcro® tape. Otherwise, if it is assumed that an extraneous item of a specific unit where a male Velcro® tape is formed is 6 cm wide and 7.5 cm long, when the extraneous item is attached to the surface of the pocket, the remaining region where the female Velcro® tape is formed is exposed to the outside, thereby deteriorating the aesthetic appearance.

More concretely, although the female Velcro® tape is of a structure different from the pattern or color of the military uniform, the extraneous item where the male Velcro® tape is formed cannot sufficiently cover the larger region where the female Velcro® tape is formed because the extraneous item is smaller than the female Velcro® tape. Thus, the aesthetic appearance of the military uniform is deteriorated by a blank portion of the female Velcro® tape exposed, and the basic function of the military uniform carrying out the function of camouflage clothes as well is damaged.

SUMMARY

An aspect of this document is to provide an apparatus for attaching an extraneous item to a military uniform, which is kept stiff for a long period of time by improving the structure of the extraneous item to be attached to the military uniform.

Another aspect of the present invention is to provide an apparatus for attaching an extraneous item to a military uniform, which prevents the aesthetic appearance of the military uniform from deterioration by improving the structure of the extraneous item to be attached to the military uniform, and which makes the blank of the female Velcro® tape not exposed to the outside even if the extraneous item is attached over the female Velcro® tape formed on the military uniform.

In order to effectively achieve the aforementioned aspects, the present invention provides an apparatus for attaching an extraneous item to a military uniform, which comprises: a female Velcro® tape where an attaching means is formed in order to attach an extraneous item, such as a name tag, a unit marking, insignia of rank, etc. at a predetermined position of the military uniform; and an attaching member which is formed with the same size as the female Velcro® tape, has the same pattern or color as the military uniform formed on the surface and a male Velcro® tape formed on the back side, and has the extraneous item attached on the surface, wherein the extraneous item comprises a name tag, a unit marking, insignia of rank, etc.; and a core material is further provided within the extraneous item or the attaching member, for keeping the male Velcro® tape or attaching member tight.

In a first configuration example for achieving the objects of the present invention, it is effective that the core material is attached to the inner surface of the extraneous item or attaching member by a double-sided tape or adhesive.

BRIEF DESCRIPTION OF THE DRAWINGS

The implementation of this document will be described in detail with reference to the following drawings in which like numerals refer to like elements.

DETAILED DESCRIPTION

Hereinafter, the construction of this invention will be described in detail with reference to the attached drawings. It is to be expressly understood, however, that the drawings are for illustrative purposes only and are not to be construed as defining the limits of the invention.

Figure 1:
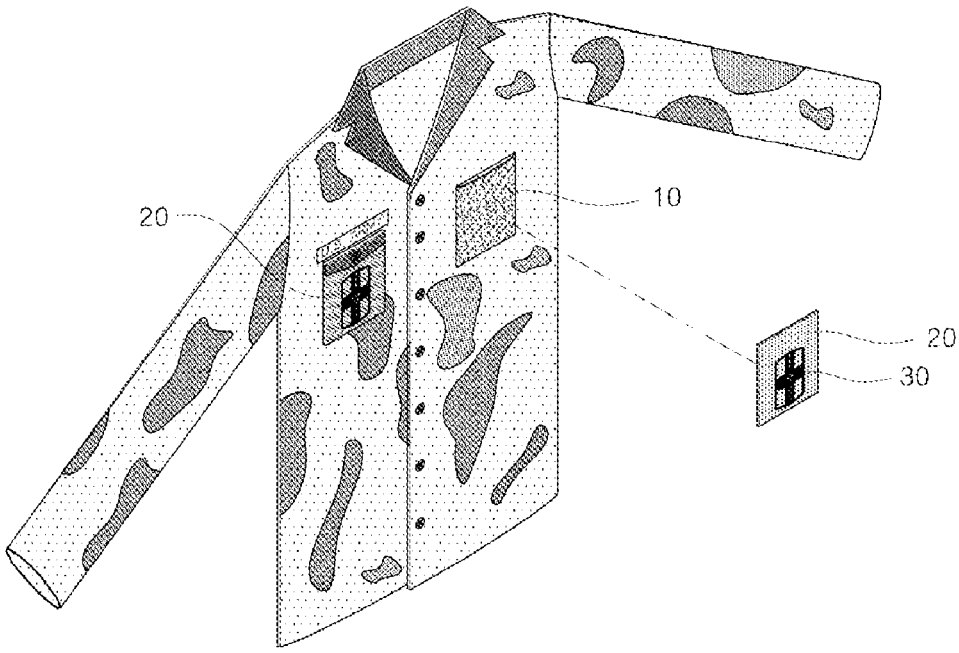
FIG. 1 is an illustration showing a state in which the present invention is installed.
Figure 2:
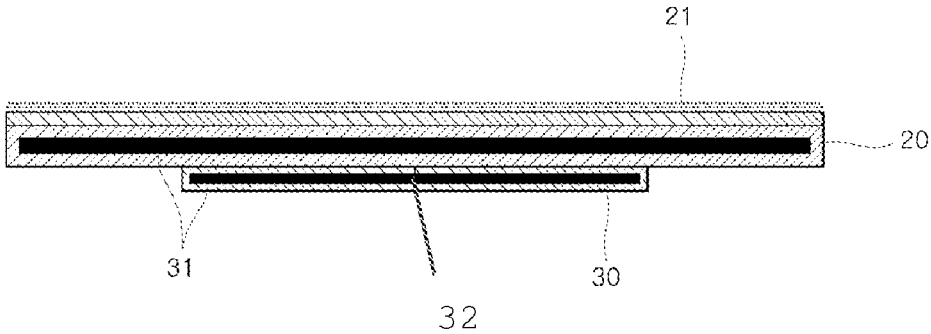
FIG. 2 is a cross sectional view showing essential parts of the present invention.

FIG. 1 is an illustration showing a state in which the present invention is installed. FIG. 2 is a cross sectional view showing essential parts of the present invention.

As expressed in the drawings, in the present invention, a female Velcro® tape 10 is formed as an attaching means at a preset position of a military uniform so as to attach an extraneous item, such as a name tag, unit marking, insignia of rank, etc., to a predetermined position of the military uniform.

An attaching member 20 functioning as a male Velcro® tape is installed on the female Velcro® tape 10 so as to be attachable and removable.

For this, the attaching member 20 is formed with the same size as the female Velcro® tape 10, the same pattern or color as the military uniform is formed on the surface, and the male Velcro® tape 21 is formed on the back side.

An extraneous item 30, comprising a name tag, a unit marking, insignia of rank, etc., is attached to the surface of the attaching member 20 by sewing.

The attaching member 20 or extraneous item 30 has a core material 31 installed therein so as to be kept stiff.

The core material 31 is kept surrounded by fibers constituting the attaching member 20 or extraneous item 30, being attached to the inner surface of the attaching member 20 or extraneous item 30 by a double-sided tape or adhesive 32.

The core material 31 may be provided as synthetic resin or having the property of keeping a round shape all the time or a metal material of a thin sheet metal.

The operation and effects of the present invention thus constructed will be described.

When installing the present invention for the first time, as shown in FIG. 1, the attaching member 20 is attached to the female Velcro® tape 10 for use.

Of course, the attaching member 20 is formed with the same size as the female (Velcro®) tape 10, and has a separate extraneous item 30 attached to the surface thereof.

In the case that the attaching member 20 to which the present invention is applied is attached to the female Velcro® tape 10, as the surface of the female Velcro® tape 10 is completely sealed by the attaching member 20, the female Velcro® tape 10 having a different pattern or color from that of the military uniform is not recognizable from outside.

In the case that the military uniform needs washing during use in the above-described state, the military uniform is washed after removing only the attaching member 20, and when the washing is finished, the attaching member 20 is attached again for use.

Of course, another feature of the present invention is that even if the attaching member 20 or extraneous item 30 is used for a long period of time and washed repetitively for a long period of time, it is kept in the initial stiff state due to the structure having a separate core material 31 installed therein.

As will be understood by those familiar with the art, the present invention may be embodied in other specific forms without departing from the spirit or essential characteristics thereof.

It is to be understood that the embodiments described herein are illustrative in every point and not restrictive. The scope of the invention is, therefore, indicated by the appended claims of the registered utility model to be described later rather than by the detailed description above. Therefore, all changes which come within the meaning and range of equivalency of the claims of the registered utility model are to be considered embraced within their scope.

What is claimed is:

1. An apparatus for attaching an extraneous item to a military uniform, which comprises a female hook and loop fastener tape where an attaching means is formed in order to attach an extraneous item, such as a name tag, a unit marking, insignia of rank, etc. at a predetermined position of the military uniform, and an attaching member sized substantially the same as a size of the female hook and loop fastener tape, has the same pattern or color as the military uniform formed on the surface and a male Velcro tape formed on a first side of the attaching member, and has the extraneous item attached on a second side of the attaching member, wherein the extraneous item comprises a name tag, a unit marking, or insignia of rank; and a core material including a metal sheet provided within the extraneous item or the attaching member, for securing the male hook and loop fastener tape or attaching member.

2. The apparatus of claim 1, wherein the core material is attached to the inner surface of the extraneous item or attaching member by a double-sided tape or adhesive.

* * * * *